US006247452B1

(12) United States Patent
Dittus et al.

(10) Patent No.: US 6,247,452 B1
(45) Date of Patent: Jun. 19, 2001

(54) FUEL INJECTION VALVE FOR INTERNAL COMBUSTION ENGINES

(75) Inventors: Bernd Dittus, Tamm; Friedrich Boecking, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/319,533

(22) PCT Filed: Jun. 16, 1998

(86) PCT No.: PCT/DE98/01628

§ 371 Date: Jul. 21, 1999

§ 102(e) Date: Jul. 21, 1999

(87) PCT Pub. No.: WO99/19619

PCT Pub. Date: Apr. 22, 1999

(30) Foreign Application Priority Data

Oct. 9, 1997 (DE) ..... 197 44 518

(51) Int. Cl.[7] ..... F02M 41/00

(52) U.S. Cl. ..... 123/459; 123/458; 239/533.9

(58) Field of Search ..... 123/467, 456, 123/458, 459, 514; 239/533.2–533.12, 585.1, 585.5, 86, 87, 88, 95, 96

(56) References Cited

U.S. PATENT DOCUMENTS

| | | | | |
|---|---|---|---|---|
| 3,610,529 | * | 10/1971 | Huber | 239/96 |
| 3,640,466 | * | 2/1972 | Steiger | 239/94 |
| 4,156,560 | * | 5/1979 | Chklich et al. | 251/30 |
| 4,566,416 | * | 1/1986 | Berchtold | 123/458 |
| 5,409,165 | * | 4/1995 | Carroll, III et al. | 239/88 |
| 5,685,483 | * | 11/1997 | Ganser | 239/89 |

* cited by examiner

*Primary Examiner*—Henry C. Yuen
*Assistant Examiner*—Mahmoud M Gimie
(74) *Attorney, Agent, or Firm*—Ronald E. Greigg; Edwin E. Greigg

(57) ABSTRACT

A fuel injection valve for internal combustion engines, having an axially displaceable valve member which is disposed in a valve body. On an end toward an engine combustion chamber the valve member has a conical valve sealing face with which the valve member cooperates with a conical valve seat face on the valve body for controlling an injection cross section. Via an internal guide the valve member is guided slidingly displaceably on a tang of a stationary insert body.

17 Claims, 3 Drawing Sheets

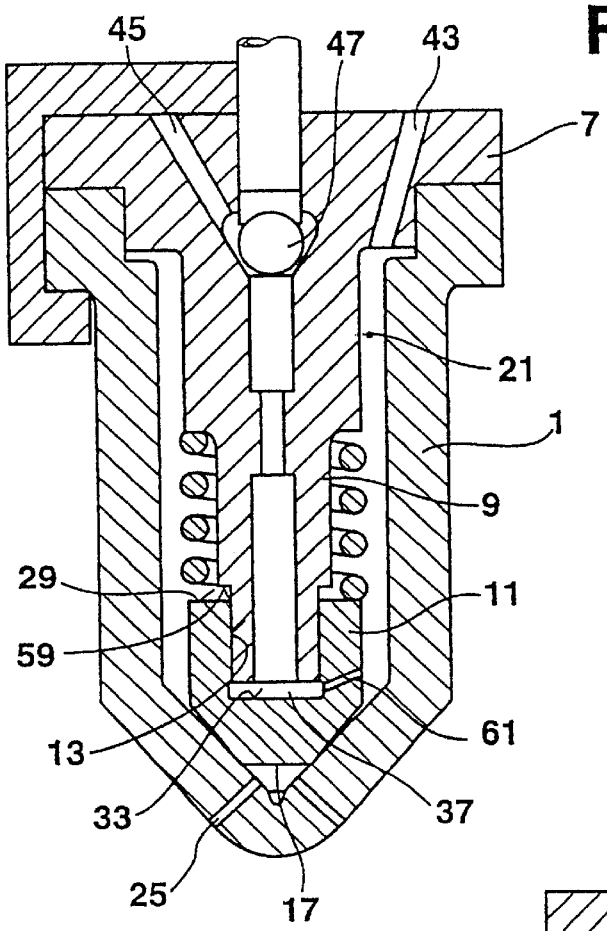
Fig. 4
Fig. 5
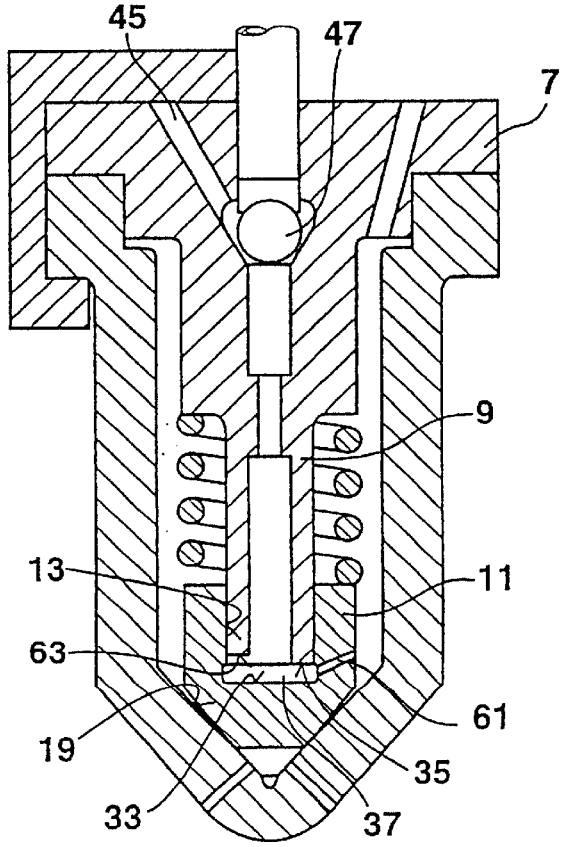

FUEL INJECTION VALVE FOR INTERNAL COMBUSTION ENGINES

PRIOR ART

The invention is based on a fuel injection valve for internal combustion engines. In one such fuel injection valve, known from U.S. Pat. No. 4,972,997, a pistonlike valve member is guided axially displaceably in a bore of a valve body. The valve member, on its end toward the combustion chamber, has a conical valve sealing face, with which it cooperates with a conical valve seat face on the valve body, which face is formed on the inward-projecting end of the closed valve bore. A contact edge between the valve sealing face on the valve member and the valve seat face forms an encompassing sealing edge. This sealing edge, formed when the injection valve is closed, thus seals off a pressure chamber, adjoining the sealing edge upstream of the pressure chamber, when the injection valve is closed. Downstream of this sealing edge, at least one injection opening that discharges into the combustion chamber of the engine to be supplied is provided in the wall of the valve body and leads away from the valve seat face.

However, this known fuel injection valve has the disadvantage that the control times of the valve member, because of the strong hydraulic forces on the valve member, are too long for injection valves that switch at very high speed. The known fuel injection valve is therefore very large, because there are so many components axially in line with one another, which limits the utility of the known fuel injection valves in engines where the available installation space is scarce.

ADVANTAGES OF THE INVENTION

The fuel injection valve of the invention for internal combustion engines, has an advantage over the prior art that very slight control forces and thus very rapid valve stroke motions of the valve member of the injection valve are possible. These rapid adjustment motions become possible because of the small hydraulically operative surface areas of the valve member and the small control volume, since only small moving masses have to be displaced. This is advantageously attained in that the valve member has a guide bore, with which it is slidably displaceably guided on a tang of a stationary insert body. The displaceable valve member is hydraulically pressure-balanced in the intervals between injections, so that no leakage losses occur. Thus sealing from the outside for outflowing leaking oil is unnecessary, and along with the leakage heat development and any possible entry of dirt can also be reduced, because of the good separation between sealing components and guidance components. A further advantage is attained because of the very short structural design of the fuel injection valve of the invention; as a result, the required installation space in the engine to be supplied can also be reduced sharply. The restoring spring that urges the valve member of the injection valve in the closing direction merely needs to close the injection valve when the system is pressureless, and thus it can be made correspondingly small in size. During the high-pressure-filled mode, the closing movement and the holding of the valve member on the valve seat face are effected by means of the design of the hydraulic opening and closing faces that are operative at the valve member. The hydraulic engagement area of the closing faces on the valve member, when the injection valve is closed, is greater than the hydraulic engagement areas acting in the opening direction. The opening stroke motion of the valve member is advantageously limited by mechanical stroke stop faces on the tang of the stationary insert body, but hydraulic stroke stops are alternatively possible as well. The control valve that opens the control chamber into a relief chamber can be embodied as a 2/2-way magnet valve, as shown in the exemplary embodiment, but 2/3-, 3/2- or 3/3-way control valves can also be used as an alternative. The valve member is guided axially over its inner guide bore on the tang of the stationary insert body, but it is also possible to provide a further guide on the outer circumference of the valve member, inside the valve body, in addition. When this kind of improved guide is used, fuel flow openings on the valve member are provided which enable a flow of fuel from a pressure chamber to the valve seat faces; these openings can be embodied as ground face sections on the jacket face of the valve member, or as through bores. The valve member itself can advantageously be embodied in two parts, with a headpiece that has the valve sealing face being inserted, preferably press-fitted, into a sleeve. This kind of two-piece valve member can be produced in a simple way and with high precision. A further advantage of the fuel injection valve of the invention is the possibility of hydraulically floating support of the insert body, carrying the tang, in the valve body, so that the insert body, and the valve member guided on the insert body, can be reliably centered relative to the valve body.

Further advantages and advantageous features of the subject of the invention can be learned from the description, drawing and claims.

BRIEF DESCRIPTION OF THE DRAWINGS

Five exemplary embodiments of the fuel injection valve of the invention for internal combustion engines are shown in the drawing and described in detail in the ensuing description.

FIG. 4 shows a third exemplary embodiment with a stroke stop for the valve member formed by a shoulder on the circumference of the tang;

FIG. 5 shows a fourth exemplary embodiment of the fuel injection valve, in which the stroke stop of the valve member is formed by a stepped end face of the tang.

DESCRIPTION OF THE EXEMPLARY EMBODIMENTS

Figure 1:
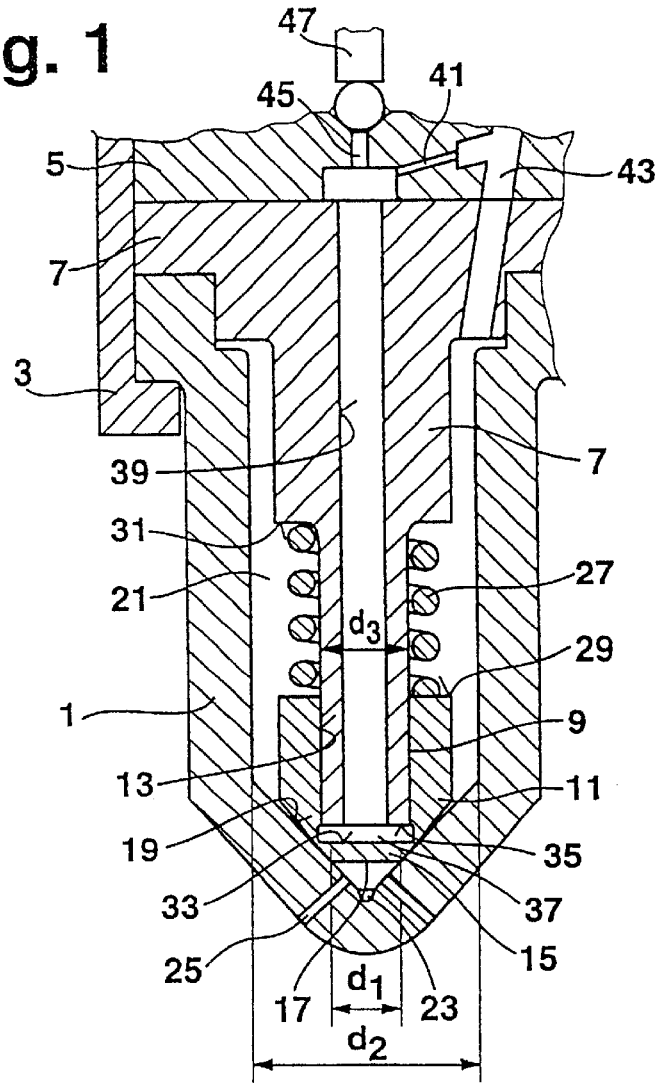
FIG. 1 shows a first exemplary embodiment of the fuel injection valve in a longitudinal section, in which the fuel delivery and relief of the control chamber or work chamber between the tang and the valve member is effected via a central through bore in the tang.

The exemplary embodiment, shown in FIG. 1, of the fuel injection valve of the invention for internal combustion engines has a cylindrical valve body 1, which protrudes with its free lower end into a combustion chamber, not identified by reference numeral, of the engine to be supplied. The valve body 1, embodied as a hollow body, is braced axially by a lock nut 3 against a valve holding body 5; an insert body 7 is fastened between the end faces, facing one another, of the valve body 1 and of the valve holding body 5. This stepped, cylindrical insert body 7, on its end remote from the valve holding body, has a tang 9 with which it protrudes into the interior of the valve body 1. On the free end of the tang 9, a cylindrical valve member 11 is axially displaceably guided with a central guide bore 13. This valve member 11, on its closed face end remote from the tang 9, has a conical valve sealing face 15, which is divided into two regions with different cone angles; at the transition between the two cone angles of the valve sealing face 15, an encompassing sealing edge 17 is formed on the valve member 11. With its valve sealing face 15, the valve member 11 cooperates with a valve seat face 19 formed on the closed, inward-projecting end of the interior in the valve body 1; when the valve member 11 is on the valve seat face 19, the sealing edge 17 on the valve member 11 divides an upstream pressure chamber 21, formed in the interior of the valve body 1, from a blind bore 23 located downstream of the sealing edge 17, from whose valve seat face 19 downstream of the sealing edge 17 injection openings 25 lead away into the engine combustion chamber. For secure contact of the valve member 11 with the valve seat face 19 when the system is pressureless, a restoring spring 27 is fastened between an annular end face 29, remote from the valve seat 19, on the valve member 11 and a shoulder 31 on the tang 9, and the restoring spring urges the valve member 11 in the direction of the valve seat face 19. A hydraulic work or control chamber 37 is also formed, between the end face 33 on the closed end of the guide bore 13 in the valve member 11 and the end face 35 of the tang 9. This control chamber 37 is filled with fuel at high pressure and relieved via an axial through bore 39 in the insert body 7. To that end, the through bore 39 is connected, via a throttle bore 41 in the valve holding body 5, to a high-pressure line 43, which in turn discharges at a high-pressure storage chamber, not shown in further detail, which is constantly filled with fuel at high pressure via a high-pressure feed pump and to which preferably all the injection valves of the injection system are connected. For pressure relief of the control chamber 37, the through bore 39 discharging into it communicates with a relief line 45 in the valve holding body 5; this line discharges into a low-pressure relief chamber, not shown in further detail, and is closable by means of a control valve 47. This control valve 47, which can be triggered arbitrarily from outside, is embodied in this exemplary embodiment as a 2/2-way valve and is preferably actuated by a magnet valve.

For adjusting the valve member 11, the annular end face 29 and the end face 33 of the guide bore 13 act as hydraulic pressure engagement faces on the valve member 11 that act in the closing direction. In the opening direction, the valve sealing face 15 is active; when the valve member 11 is on the valve seat 19, initially its region adjoining the sealing edge 17 upstream is active. The valve diameter at the sealing edge 17 forms a first diameter d1; the diameter of the outer circumference of the cylindrical valve member 11 forms a second diameter d2; and the diameter of the outer circumference of the tang 9 forms a third diameter d3. The diameter d3, for reliable function of the fuel injection valve, must be greater than the diameter d1, which defines the seat diameter at the valve sealing seat.

The fuel injection valve of the invention functions as follows: At the onset of operation of the injection system, the high-pressure storage chamber, not shown in detail, is filled with fuel at high pressure by the high-pressure fuel pump. This pressure is carried via the individual high-pressure lines 43 to the various injection valves protruding into the engine combustion chamber. In the process, the high fuel pressure, in the first exemplary embodiment, reaches the pressure chamber 21 via the high-pressure line 43 and the control chamber 37 via the throttle bore 41 that branches off from the high-pressure line 43 and via the through bore 39 in the insert body 7. The control valve 47 keeps the relief line 45 closed under these circumstances. In this closed state of the fuel injection valve during the intervals between injection, the annular end face 29 and the end face 33 of the inner guide bore 13 on the valve member 11 act in the closing direction and thus urge the valve member 11 toward the valve seat face 19. At the same time, the high fuel pressure in the pressure chamber 21 engages the valve member 11 in the opening direction, at the valve seat face 19 formed upstream of the sealing edge 17. The hydraulic pressure engagement faces on the valve member 11 are embodied in such a way, however, that in this situation the faces 29, 33 acting in the closing direction are larger than the areas of the valve sealing face 15 acting in the opening direction, and thus the valve member 11 is held hydraulically in contact with the valve seat face 19. If an injection at the injection valve is to take place, then the control valve 47 is actuated in the opening direction, causing the control valve to open the relief line 45 into a low-pressure chamber. As a consequence, the pressure in the control chamber 37 drops very quickly via the through bore 39 into the relief line 45, so that this hydraulic pressure force engaging the valve member 11 in the closing direction is reduced. Since the pressure engagement area on the valve sealing face 15 that acts in the opening direction is greater than the annular end face 29 acting in the closing direction, the valve member 11 is lifted from the valve seat 19 counter to the force of the restoring spring 27, so that the fuel can flow out of the pressure chamber 21 via the opening cross section uncovered between the valve seat face 19 and the valve sealing face 15, into the injection openings 25 and on into the engine combustion chamber. The throttle bore 41 assures that the high fuel pressure flowing in from the high-pressure line 43 will not immediately flow out in a short circuit into the relief line 45. The injection at the injection valve is ended when the control valve 47 re-closes the relief line 45, so that in the control chamber 37, via the bores 41 and 39, a high fuel pressure can build up again that then, via the engagement face 33 and the annular end face 29, again displaces the valve member 11 into contact with the valve seat face 39. Since when the injection valve is closed the hydraulic pressure inside and outside the displaceable valve member 11 is of equal magnitude, any leakage flow at the valve member 11 into the low-pressure chamber can be averted. The valve member 11, during its reciprocating motion, is thus securely guided axially slidingly displaceably by means of its internal guidance on the tang 9 of the insert body 7.

Figure 2:
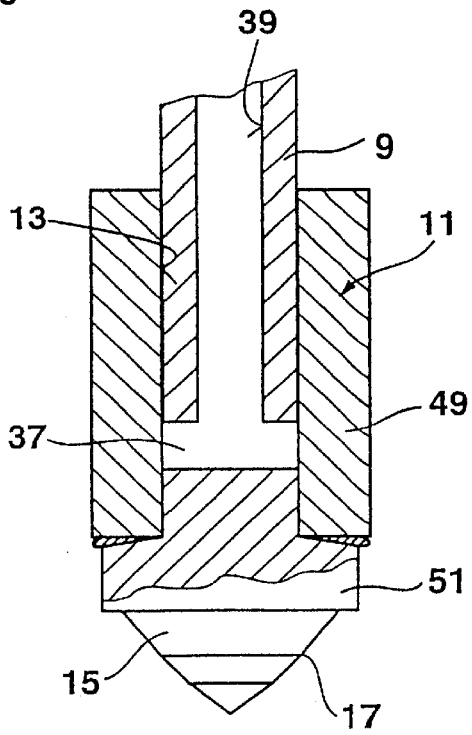
FIG. 2 shows an enlarged detail of the valve member of FIG. 1, which is in two parts and is guided on the tang.

In FIG. 2, one possible embodiment of the valve member 11 as a two-piece component is shown in an enlarged, fragmentary detail view. The valve member 11 has a sleeve 49, which is guided slidably displaceably by its inside diameter on the tang 9 of the insert body 7, and into whose lower end, toward the combustion chamber, a headpiece 51 embodied as a stepped cylinder is press-fitted, which headpiece has the valve sealing face 15 and the sealing edge 17 on its face end remote from the sleeve 49. The headpiece 51 is preferably inserted with a tanglike extension into the inner diameter of the sleeve 49 and welded at the annular shoulder face to the annular end face of the sleeve 11.

Figure 3:
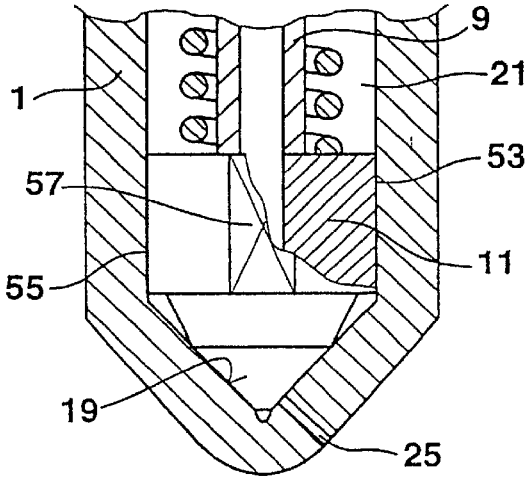
FIG. 3 shows a second exemplary embodiment of the fuel injection valve, in which the valve member has an additional external guide in the valve body.

In FIG. 3, a second exemplary embodiment of the fuel injection valve of the invention is shown, in which the valve member 11, in addition to the internal guidance on the bore 13, is guided via an external guide on the inner wall of the valve body 1. The outer circumferential wall 53 of the valve member 11 forms this second, additional guide face that slides on the inner wall face 55 of the valve body 1. For fuel passage from the pressure chamber 21 to the valve seat face 19, recesses are provided on the outer circumference of the valve member 11, which are preferably embodied as ground face sections 57.

FIGS. 4 and 5 show two further exemplary embodiments of the fuel injection valve, in which to limit the opening stroke motion of the valve member 11, various mechanical stroke stops are provided. FIG. 4 shows a third exemplary embodiment, in which the stroke stop for the valve member 11 is embodied as an annular shoulder 59 on the jacket face of the tang 9 of the insert body 7. With this annular shoulder face 59, the valve member 11 comes into contact, after completing its total opening stroke course, with the annular end face 29.

Filling of the control chamber 37 between the tang 9 and the closed end face 33 of the guide bore 13 in the valve member 11 also now takes place directly from the pressure chamber 21, to which end a throttle bore 61 is provided in the valve member 11; beginning at the control chamber 37, this bore discharges into the pressure chamber 21 at the jacket face of the valve member 11.

The fourth exemplary embodiment shown in FIG. 5 differs from the third exemplary embodiment shown in FIG. 4 only in the type of stroke stop for limiting the opening stroke motion of the valve member 11. The opening stroke of the valve member 11 is now limited by the contact of the end face 33 of the bore 13 in the valve member 11 with the end face 35 of the tang 9 of the insert body 7. To that end, the annular end face 35 of the tang 9 has a shoulder 63, which is axially offset inward and which assures that the end face 33 on the valve member 11 acting in the closing direction will be preserved. In this way, by means of the control valve 47 in the event of wear of the relief line 45, at the end of the injection phase and with refilling of the control chamber 37 with fuel at high pressure via the throttle bore 61, the restoring motion of the valve member 11 to the valve seat 19 can remain reliably assured. The opening stroke course of the valve member 11 can be adjusted in a simple way via the axial length of the stationary insert body 7.

Figure 6:
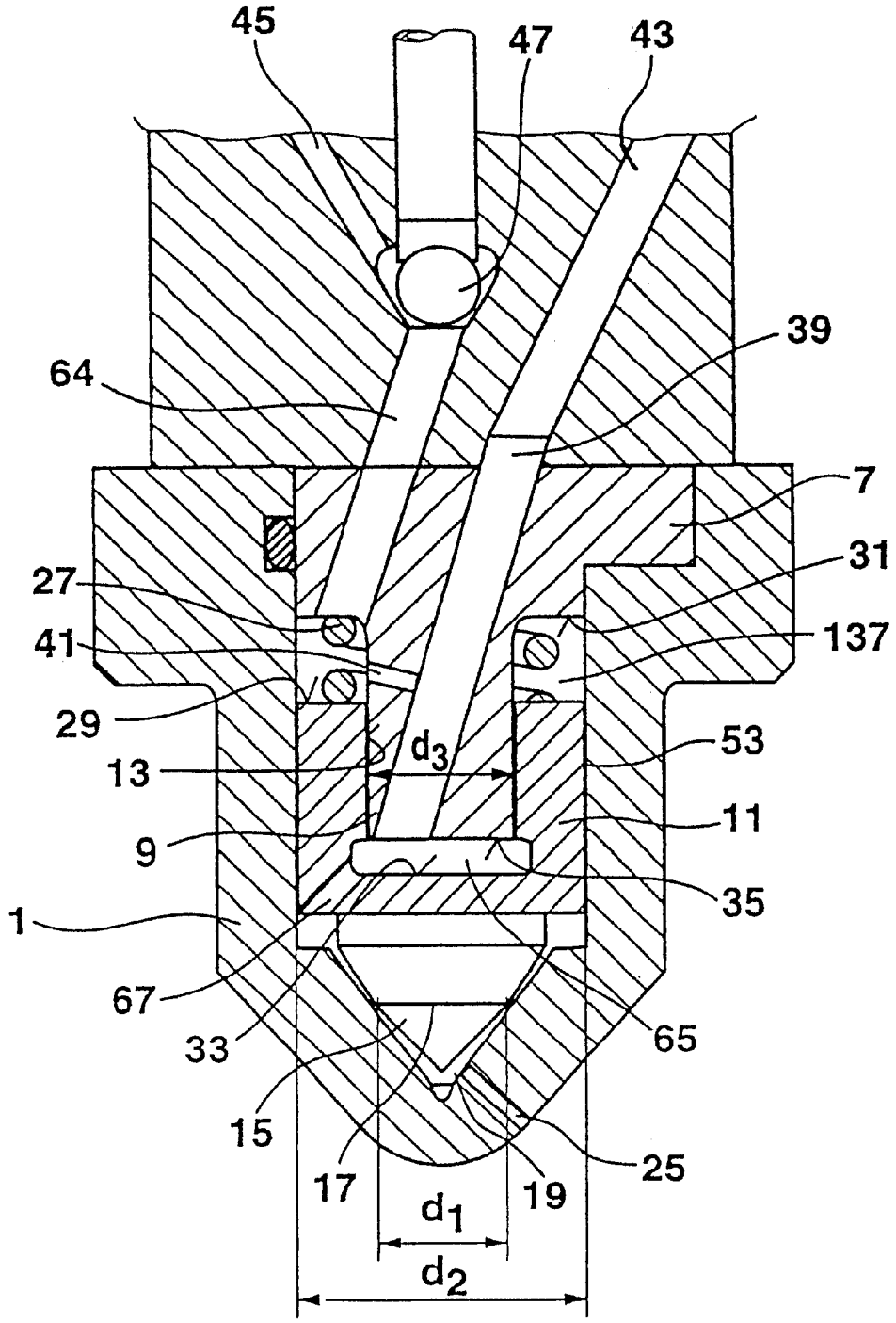
FIG. 6 shows a fifth exemplary embodiment of the fuel injection valve, in which the work or control chamber is disposed outside the tang of the insert body.

In the fifth exemplary embodiment shown in FIG. 6, the control chamber 37, unlike the preceding exemplary embodiments, is disposed outside the valve member 11. To that end, analogously to the second exemplary embodiment, the valve member 11 is guided both inside on the guide bore 13 and outside on the circumferential wall 53 of the valve member 11. A chamber formed between the rear annular end face 29 on the valve member 11 and the shoulder 31 on the stationary insert body 7 forms the control chamber 137 in the fifth exemplary embodiment, and the restoring spring 27 is also disposed in it. A relief conduit 64 leads away from the control chamber 137 and can be opened by the control valve 47 into the relief line 45. The hydraulic work chamber 65 enclosed between the end face 35 of the tang 9 and the closed end face 33 of the bore 13 on the valve member 11 is refilled with fuel at high pressure from a high-pressure fuel collection tank via a through bore 39 and a high-pressure line 43. A connecting bore 67 leads away from the hydraulic work chamber 65 and discharges into a chamber, near the valve seat, inside the valve body 1. The high-pressure fuel supply to the control chamber 137 is effected via a throttle bore, which from the through bore 39 in the insert body 7 discharges into the control chamber 137.

In the fifth exemplary embodiment, the opening stroke motion of the valve member 11 is effected by the pressure relief of the externally located control chamber 137 via the relief conduit 64 and the relief line 45. The end face 33 inside the valve member 11, with its diameter d3, continues to act in the closing direction of the valve member 11. The hydraulic pressure area, that engages the valve member 11 in the opening direction and formed by the difference in diameter between the outer circumference of the valve member 11 (d2) and the diameter at the seat edge 17 (d1), must be greater than the end face 33 on the valve member 11 now acting solely in the closing direction. The closing stroke motion of the valve member 11 is effected, analogously to the preceding exemplary embodiments, by the renewed closure of the relief line 45, as a consequence of which a high fuel pressure builds up again in the control chamber 137 via the throttle bore 41; this pressure urges the valve member 11, at the annular end face 29 in addition to the end face 33, in the closing direction and thus pushes the valve member 11 back into contact with the valve seat face 19.

The foregoing relates to preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising an axially displaceable valve member (11), said valve member is disposed in a valve body (1) and on an end toward an engine combustion chamber has a conical valve sealing face (15), said conical sealing face cooperates with a conical valve seat face (19) on the valve body (1), the conical valve sealing face (15) on the valve member (11) has an annular edge that forms a sealing edge (17), and includes at least one injection opening (25) into the engine combustion chamber, in a region of the valve seat face (19) adjoining the sealing edge (17) of the valve member when the injection valve is closed, the valve member (11) has a guide bore (13), with which the valve member is slidably displaceably guided on a tang (9) of a stationary insert body (7).

2. The fuel injection valve according to claim 1, in which in the valve body (1), a high-pressure chamber (21) is formed, which discharges at the valve seat face (19) and which communicates constantly, via a high-pressure line (43), with a high-pressure storage chamber filled with fuel at high pressure.

3. The fuel injection valve according to claim 1, in which between a closed end face (33) of the guide bore (13) in the valve member (11) and an end face (35) of the tang (9) of the insert body (7), a work chamber is defined which is filled with fuel at high pressure from the high-pressure chamber (21) or the high-pressure line (43).

4. The fuel injection valve according to claim 1, in which a control chamber (37, 137) which is filled with high fuel pressure is provided in the valve body (1), and an internal pressure urges the valve member (11) in a closing direction, and the control chamber is pressure-relieved into a low-pressure chamber via an openable relief line (45).

5. The fuel injection valve according to claim 4, in which a control valve (47) actuatable from outside is inserted into the relief line (45).

6. The fuel injection valve according to claim 3, in which the control chamber (37) is formed by the work chamber between the end face (33) on the valve member (11) and the end face (35) on the tang (9).

7. The fuel injection valve according to claim 4, in which the control chamber (37) is formed by the work chamber between the end face (33) on the valve member (11) and the end face (35) on the tang (9).

8. The fuel injection valve according to claim 6, in which the control chamber (37) communicates with the high-pressure line (43) or the high-pressure chamber (21) via an inlet conduit that includes a throttle restriction (41).

9. The fuel injection valve according to claim 7, in which the control chamber (37) communicates with the high-pressure line (43) or the high-pressure chamber (21) via an inlet conduit that includes a throttle restriction (41).

10. The fuel injection valve according to claim 4, in which the control chamber (137) is disposed radially outward of the tang (9) of the stationary insert body (7) and is defined by an annular end face (29), remote from the combustion chamber, of the valve member (11).

11. The fuel injection valve according to claim 10, in which the control chamber (137) is made to communicate constantly with the high-pressure line (43) via a throttle bore (41) and is made to communicate with a low-pressure chamber via a connectable relief line (45).

12. The fuel injection valve according to claim 1, in which a restoring spring (27) that urges the valve member (11) in the closing direction is fastened between the valve member (11) and the insert body (7).

13. The fuel injection valve according to claim 1, in which the valve member (11) is formed by a sleeve (49), having an opening toward the combustion chamber, a head piece (51) is inserted into the opening, and the valve sealing face (15) is disposed on a face end of the head piece remote from the sleeve (49).

14. The fuel injection valve according to claim 1, in which the opening stroke length of the valve member (11) is limited by a stroke stop.

15. The fuel injection valve according to claim 14, in which the stroke stop is formed by an annular shoulder (59) on the cylindrical tang (9) of the insert body (7).

16. The fuel injection valve according to claim 14, in which the stroke stop is formed by a shoulder (63) on the side toward the valve member of the annular end face (35) of the tang (9) of the insert body (7).

17. The fuel injection valve according to claim 1, in which the valve member (11) is additionally guided by a radial jacket face (53) on an inner wall (55) of the valve body (1), and through conduits (57, 67) provided on the valve member (11) for fuel flow.

* * * * *